US010047618B2

(12) United States Patent
Hess et al.

(10) Patent No.: US 10,047,618 B2
(45) Date of Patent: Aug. 14, 2018

(54) COMPONENT SYSTEM OF A TURBO ENGINE

(71) Applicant: MTU Aero Engines AG, Munich (DE)

(72) Inventors: Thomas Hess, Munich (DE); Manfred Feldmann, Eichenau (DE)

(73) Assignee: MTU Aero Engines AG, Munich (DE)

( * ) Notice: Subject to any disclaimer, the term of this patent is extended or adjusted under 35 U.S.C. 154(b) by 542 days.

(21) Appl. No.: 14/494,011

(22) Filed: Sep. 23, 2014

(65) Prior Publication Data

US 2015/0086331 A1 Mar. 26, 2015

(30) Foreign Application Priority Data

Sep. 23, 2013 (DE) ..... 10 2013 219 024

(51) Int. Cl.
*F01D 11/00* (2006.01)
*F01D 9/04* (2006.01)
*F01D 25/24* (2006.01)

(52) U.S. Cl.
CPC ..... *F01D 11/001* (2013.01); *F01D 9/04* (2013.01); *F01D 11/005* (2013.01); *F01D 25/24* (2013.01);
(Continued)

(58) Field of Classification Search
CPC .... F01D 11/001; F01D 11/005; F01D 11/006; F01D 11/02; F01D 9/04; F01D 25/24;
(Continued)

(56) References Cited

U.S. PATENT DOCUMENTS 4,422,827 A 12/1983 Buxe et al.
4,573,866 A * 3/1986 Sandy, Jr. ..... F01D 11/08 415/116

(Continued)

FOREIGN PATENT DOCUMENTS

DE 10 2011 054 654 4/2012
EP 1 013 788 6/2000

(Continued)

*Primary Examiner* — Logan Kraft
*Assistant Examiner* — Danielle M Christensen
(74) *Attorney, Agent, or Firm* — Davidson, Davidson & Kappel, LLC

(57) ABSTRACT

A component system of a turbine engine including a first component segment and a second component segment configurable in a ring segment shape, so that at least one abutment surface of the first component segment and an abutment surface of the second component segment abut against each other; together, the first component segment and the second component segment including at least three overlapping elements for sealing a gap between the abutment surfaces. In the case of mutually abutting abutment surfaces, each overlapping element overlapping radially with the respective other component segment. At least two of the overlapping elements are configured on the first component segment, while at least one of the overlapping elements is configured on the second component segment. In the case of mutually abutting abutment surfaces, the overlapping element of the second component segment is axially configured between the overlapping elements of the first component segment.

14 Claims, 3 Drawing Sheets

(52) U.S. Cl.
CPC ..... *F05D 2230/30* (2013.01); *F05D 2230/60* (2013.01); *F05D 2230/61* (2013.01); *Y10T 29/4932* (2015.01)

(58) Field of Classification Search
CPC ..... F05D 2230/30; F05D 2230/60; F05D 2230/61
See application file for complete search history.

(56) References Cited

U.S. PATENT DOCUMENTS

| | | | | |
|---|---|---|---|---|
| 5,218,816 | A * | 6/1993 | Plemmons | F01D 11/02 277/419 |
| 6,425,738 | B1 | 7/2002 | Shaw | |
| 6,504,127 | B1 | 1/2003 | McGregor et al. | |
| 2002/0071764 | A1 * | 6/2002 | Turnquist | F01D 5/225 415/173.3 |
| 2007/0258816 | A1 | 11/2007 | Bouchard et al. | |
| 2012/0098211 | A1 * | 4/2012 | Pandey | F01D 11/02 277/631 |
| 2013/0051989 | A1 * | 2/2013 | Durocher | F01D 9/04 415/168.1 |

FOREIGN PATENT DOCUMENTS

| | | |
|---|---|---|
| EP | 1221539 | 7/2002 |
| FR | 2 521 217 | 8/1983 |
| GB | 2 262 573 | 6/1993 |

* cited by examiner

COMPONENT SYSTEM OF A TURBO ENGINE

This claims the benefit of German Patent Application DE 10 2013 219 024.7, filed Sep. 23, 2013 and hereby incorporated by reference herein.

The present invention relates to a component system of a turbine engine, in particular of an aircraft turbine. The present invention also relates to a method for assembling such a component system, as well as to a turbine engine having such a component system.

BACKGROUND

The European Patent Application EP 1 013 788 A1 describes a component system of an aircraft turbine that includes a plurality of component segments, which are each formed as shroud segments and are configured in a housing annularly about a rotor of the aircraft engine. Each component segment includes two mutually opposing abutment surfaces, which, in the assembled state, abut against an associated abutment surface of the respective adjacent component segment. To prevent or at least reduce a passage of hot gases through a gap located between the abutment surfaces of the component segments during operation of the aircraft turbine, sealing plates are inserted into slots of the individual abutment surfaces provided for that purpose in order to seal the segment joints.

To seal such segment joints of blade rings, turbine rings and the like, it is also generally known to use component segments having simple joints, respectively abutment surfaces, and to seal the joints by installing a circumferentially extending sealing plate over these component segments. Alternatively, component segments having fixedly mounted sealing plates are used, the sealing plates resting on the respective adjacent component segment or being held in slots or clamps.

In all of the known design variations, the sealing action is greatly influenced by the various tolerance chains, however, so that only a comparatively poor sealing of the segment joints can be achieved. Moreover, the use of individual sealing plates leads to a substantial assembly and disassembly expenditure, for example, and thus to correspondingly high manufacturing and repair costs.

SUMMARY OF THE INVENTION

It is an object of the present invention to provide a component system of the type mentioned at the outset that will make possible an improved sealing and, moreover, be simpler and more economical to assemble. It is also an object of the present invention to provide a method for assembling such a component system, as well as a turbine engine having such a component system.

The present invention provides a component system that renders possible an improved sealing and, moreover, is simpler and more economical to assemble, in that at least the first component segment and the second component segment, together, include at least three overlapping elements for sealing a gap between the abutment surfaces. It is also provided in this context that each overlapping element overlap radially with the respective other component segment in the case of mutually abutting abutment surfaces; that at least two of the overlapping elements be configured on the first component segment; that at least one of the overlapping elements be configured on the second component segment; and that, in the case of mutually abutting abutment surfaces, the overlapping element of the second component segment be axially configured between the overlapping elements of the first component segment. In other words, in contrast to the related art, it is provided that component segments that are mutually adjacent in the assembled state, each include overlapping elements that, in the assembled state, overlap with the respective other component segment. This segment sealing is integrated in the component segments in such a way that, depending on the joint, respectively abutment surface pair, at least three overlapping elements are provided, at least two of the overlapping elements being affixed to the first component segment, i.e., to the first marginal edge portion, and at least one of the overlapping elements being configured on the second component segment, i.e., on the second marginal edge portion and, in addition, between the two overlapping elements of the first component segment. In the simplest case, the component system according to the present invention merely has two such components segments that complement one another to form a ring. Alternatively, it may be provided that the component system have three, four, five, six, seven, eight, nine, ten or more components segments that are provided in the aforementioned manner with overlapping elements. In general, in the assembled state, all of the component segments of the component system complement one another to form a ring whose center axis preferably extends coaxially to the axis of the rotor of the turbine engine. The advantage is derived from the alternating configuration and covering of the overlapping elements that the leakage gaps between the abutment surfaces of the component segments are at least substantially determined only by the component segments themselves, not, however, by other components. This makes it possible to greatly reduce the tolerance chain for the individual leakage gaps. In addition, the alternating configuration of the overlapping elements makes it possible to achieve that the component elements are fixed in relation to one another and do not need to be affixed by additional housing receptacles or the like. This permits a further reduction of the tolerance chain and, thus, an improved gap sealing.

One advantageous embodiment of the present invention provides that at least one of the overlapping elements be integrally formed on the component segment in question and/or be metallurgically bonded to the component segment in question. In this manner, no detachable, respectively separate parts, such as sealing plates, for example, or the like are required for the sealing, thereby substantially simplifying and improving the cost efficiency of both the manufacturing, as well as the assembly, respectively the disassembly of the component system according to the present invention. In the case of a metallurgical bond, the overlapping element in question may be fastened by welding, soldering and/or adhesively bonding the same to the respective component segment, for example.

Other advantages are derived when, in the case of mutually abutting abutment surfaces, the overlapping elements are configured at at least two radially different distances and/or in at least two radially different planes relative to the axis. In a structurally simple manner, this makes possible a mechanically particularly stable joining of the two component segments. Moreover, this very reliably prevents the component segments from being radially movable relative to one another once installation is complete.

Another advantageous embodiment of the present invention provides that the two overlapping elements of the first component segment be configured at mutually opposing outer regions of the first component segment, and/or that the overlapping element of the second component segment be configured in the axially middle region thereof. Besides a self-centering installation, this makes it possible to ensure that the component segments are neither axially nor radially, rather only circumferentially movable relative to one another. In addition, a high mechanical load-bearing capacity of the joined component segments is hereby achieved.

Another advantageous embodiment of the present invention provides that, in the case of mutually abutting abutment surfaces, the overlapping elements jointly at least substantially seal the gap between the abutment surfaces. In other words, it is provided that, in the assembled state of the component segments, the overlapping elements jointly at least substantially cover the joint gap, whereby an exceptional sealing effect is achieved. In addition, it may be provided that the overlapping elements, when they are assembled at different radial distances, respectively in different radial planes, be configured above, respectively below one another, at least regionally. This makes it possible to produce a type of labyrinth seal, whereby an exceptional sealing effect is attainable.

Other advantages are derived when at least one of the overlapping elements is configured to be hook-shaped and/or rectangular in cross section, and/or trough-shaped, and/or V-shaped, and/or U-shaped. Although the overlapping elements are generally not limited in the form design thereof, a clip-type connection between the component segments may be produced in a structurally simple manner by a hook-shaped configuration of at least one of the overlapping elements. Thus, following assembly, an unwanted relative movement of adjacent component segments is very reliably avoided in the circumferential direction. Alternatively or additionally, at least one of the overlapping elements may be configured to be rectangular, V-shaped and/or U-shaped, whereby, besides a case-optimized segment sealing, an enhanced mechanical stability, as well as a protection against unwanted relative movements of the component segments relative to one another may be additionally ensured.

A mechanically especially stable connection of the component segments is made possible in a further embodiment of the present invention in that the first component segment and/or the second component segment include at least one overlapping region that is configured to complement the associated overlapping element of the respective other component segment.

An especially effective segment sealing is achieved because the overlapping element of the second component segment has a larger surface area and/or a greater axial extent than the overlapping elements of the first component segment.

Further advantages are derived when the first component segment and/or the second component segment are/is configured as a blade ring segment and/or as a turbine ring segment. The advantages of the component system according to the present invention for the mentioned turbine elements may be hereby realized, where a reliable sealing of the abutment surfaces between the individual components segments, as well as as a simple assembly and disassembly are vitally important.

A further embodiment of the present invention achieves a geometrically especially precise manufacturing, while simultaneously maintaining low manufacturing costs in that at least one of the component segments is manufactured additively. It may also be provided that two, a plurality of, or all component segments of the component system be manufactured additively.

A second aspect of the present invention relates to a method for assembling a component system in accordance with the first inventive aspect in a turbine engine, where at least the first component segment and the second component segment of the component system are joined in a way that allows the abutment surface of the first component segment and the abutment surface of the second component segment to abut against each other; the at least two overlapping elements of the first component segment to overlap radially with the second component segment; the at least one overlapping element of the second component segment to overlap radially with the first component segment; and the overlapping element of the second component segment to be axially configured between the two overlapping elements of the first component segment. In the simplest case, the at least two component segments are slid onto each other for that purpose, so that, in the manner described above, the overlapping elements come to rest alternately on the respective other component segment. In principle, the component system may be assembled within a housing of the turbine engine or outside of the housing, and subsequently be hooked in, respectively installed as a unit in the housing. Besides an improved sealing of the gap between the abutment surfaces of the component segments, an especially simple and cost-effective assembly of the component system is hereby made possible. Accordingly, a disassembly, for example for maintenance, repair or reconditioning purposes may be undertaken in reverse sequence, respectively by circumferentially sliding apart the component segments. Further advantages resulting herefrom and features thereof will become apparent from the descriptions of the first inventive aspect; advantageous embodiments of the first inventive aspect being considered to be advantageous embodiments of the second inventive aspect and vice versa.

A third aspect of the present invention relates to a turbine engine, in particular an aircraft engine that includes a component system, which is designed in accordance with the first inventive aspect and/or is assembled using a method in accordance with the second inventive aspect. The features derived herefrom and the advantages thereof are to be inferred from the descriptions of the first and of the second inventive aspect; advantageous embodiments of the first and of the second inventive aspect being considered to be advantageous embodiments of the third inventive aspect and vice versa.

BRIEF DESCRIPTION OF THE DRAWINGS

Other features of the present invention are derived from the claims, the exemplary embodiments, as well as in light of the drawings. The aforementioned features and feature combinations mentioned in the Specification, as well as the features and feature combinations subsequently mentioned in the exemplary embodiments may be used not only in the particular stated combination, but also in other combinations, without departing from the scope of the present invention. Specifically.

DETAILED DESCRIPTION

Figure 1:
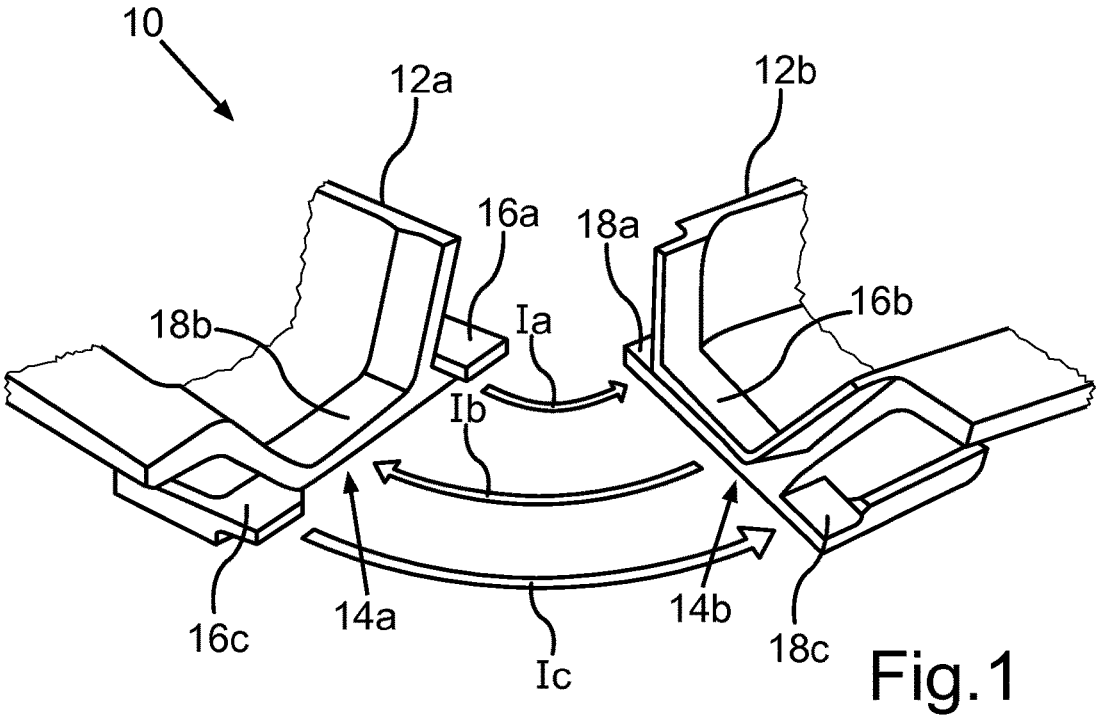
FIG. 1: shows a schematic perspective view of two component segments of a component system according to the present invention in accordance with a first specific embodiment.
Figure 3:
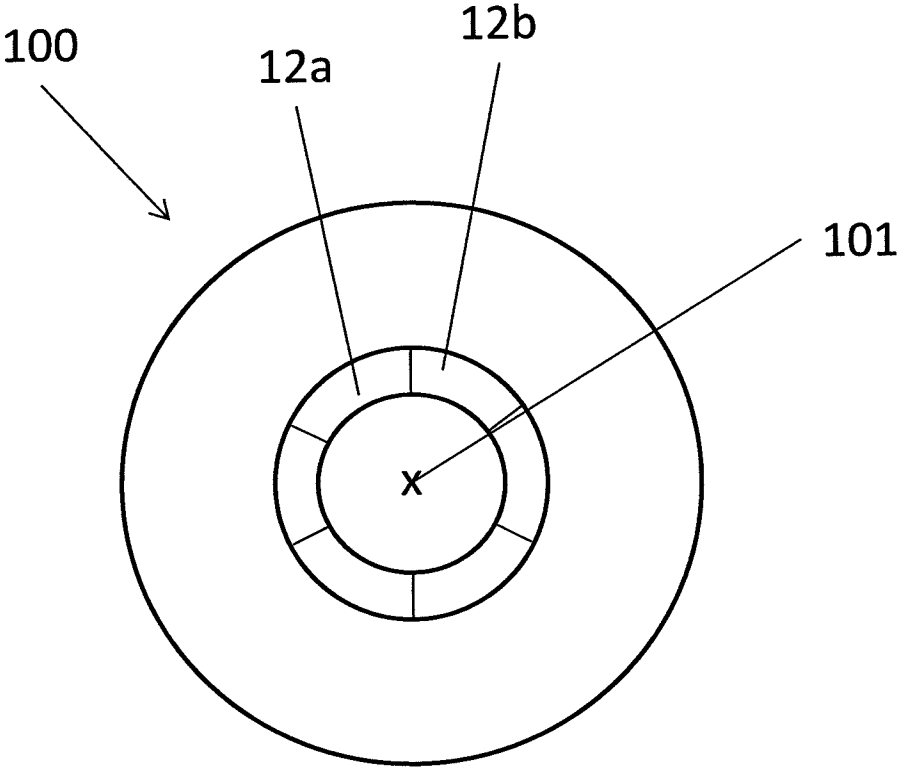
FIG. 3 shows schematically of an aircraft engine of the present invention.

FIG. 1 shows a schematic perspective view of a component system 10 in accordance with a first exemplary embodiment of the present invention. Component system 10 includes a plurality of component segments, of which merely one first component segment 12*a* and a second component segment 12*b* are shown in a cutaway view. In the present case, component system 10 is configured as a blade ring of an aircraft turbine and includes other component segments which are designed analogously to illustrated component segments 12*a*, 12*b* and complement one another to form a ring. For assembly purposes, the component segments are annularly configured about an axis 101 of a rotor of the aircraft engine 100 as shown schematically in FIG. 3, so that, in each case, an abutment surface 14*a* of first component segment 12*a* and an abutment surface 14*b* of the second component segment 12*b* abut against each other. Abutment surfaces 14*a*, 14*b* are provided in each case at the narrow sides of component segments 12*a*, 12*b*. In principle, the opposing abutment surfaces of individual components segments 12*a*, 12*b* may be designed to be identical to or to complement abutment surfaces 14*a*, 14*b*, to ensure a non-interchangeable assembly of all component segments. For the sake of assembly, all of the component segments are circumferentially slid onto each other until the particular abutment surfaces thereof abut against each other, respectively rest against each other.

In order to seal the segments between abutment surfaces 14*a*, 14*b*, component segments 12*a*, 12*b* have altogether three overlapping elements 16*a*, 16,*b*, 16*c* for each abutment surface pair. In the case of mutually abutting abutment surfaces 14*a*, 14*b*, it is discernible that overlapping elements 16*a-c* overlap radially with the respective other component segment 12*a*, 12*b*, so that component segments 12*a*, 12*b* are still only circumferentially movable relative to one another, not, however, axially or radially. As illustrated by arrow Ia, overlapping element 16*a* comes to rest on associated overlapping region 18*a*, which has a complementary form; as illustrated by arrow Ib, overlapping element 16*b* comes to rest on associated overlapping region 18*b*, which has a complementary form; and, as illustrated by arrow Ic, overlapping element 16*c* comes to rest on associated overlapping region 18*c*, which has a complementary form. As is also discernible, all of overlapping elements 16*a-c* are integrally formed with the particular component segment 12*a*, 12*b*. This may be achieved very readily and cost-effectively, for example by an additive production of component segments 12*a*, 12*b*. It is also readily apparent from FIG. 1 that individual overlapping element 16*b* is formed in the middle of second component segment 12*b* and, accordingly, in the assembled state, is configured between the particular outer overlapping elements 16*a*, 16*c* of first component segment 12*b*. It is also apparent that second, oppositely oriented overlapping element 16*b* has a larger surface area, as well as a greater axial extent than outer overlapping elements 16*a*, 16*c* of first component segment 12*a*, is formed in another, further radially outwardly disposed plane than overlapping elements 16*a*, 16*c*, and has a different geometry than overlapping elements 16*a*, 16*c*. Moreover, overlapping elements 16*a*, 16*c* are formed to be cuboid, respectively rectangular in cross section, while overlapping element 16*b* is formed to be trough-shaped, respectively virtually V-shaped in cross section. A self-centering is thereby achieved during assembly of component segments 12*a*, 12*b*. In the assembled state of component segments 12*a*, 12*b*, all three overlapping elements 16*a-c* provided completely cover the gap between abutment surfaces 14*a*, 14*b*. In other words, the sealing of segments is integrated in component segments 12*a*, 12*b* in such a way that, depending on the joint, respectively abutment surface pair, at least three overlapping elements 16*a-c* are made available, of which two overlapping elements 16*a*, 16*c* are affixed to the first marginal edge portion (component segment 12*a*), while other overlapping element 16*b* is affixed to the second marginal edge portion (component segment 12*b*), as well as between the two other overlapping elements 16*a*, 16*c*, thereby providing an alternating overlapping in the assembled state. From the alternating covering, the advantage is derived that the leakage gap is only determined by the component segments themselves, since they affix themselves to one another and do not need to be affixed by housing receptacles or the like. The tolerance chain for the leakage gap may be reduced in this manner. Moreover, no unattached, respectively separate parts are needed for the sealing. In principle, it may be provided that first component segment 12*a* and/or second component segment 12*b* have one or a plurality of further overlapping elements.

Figure 2:
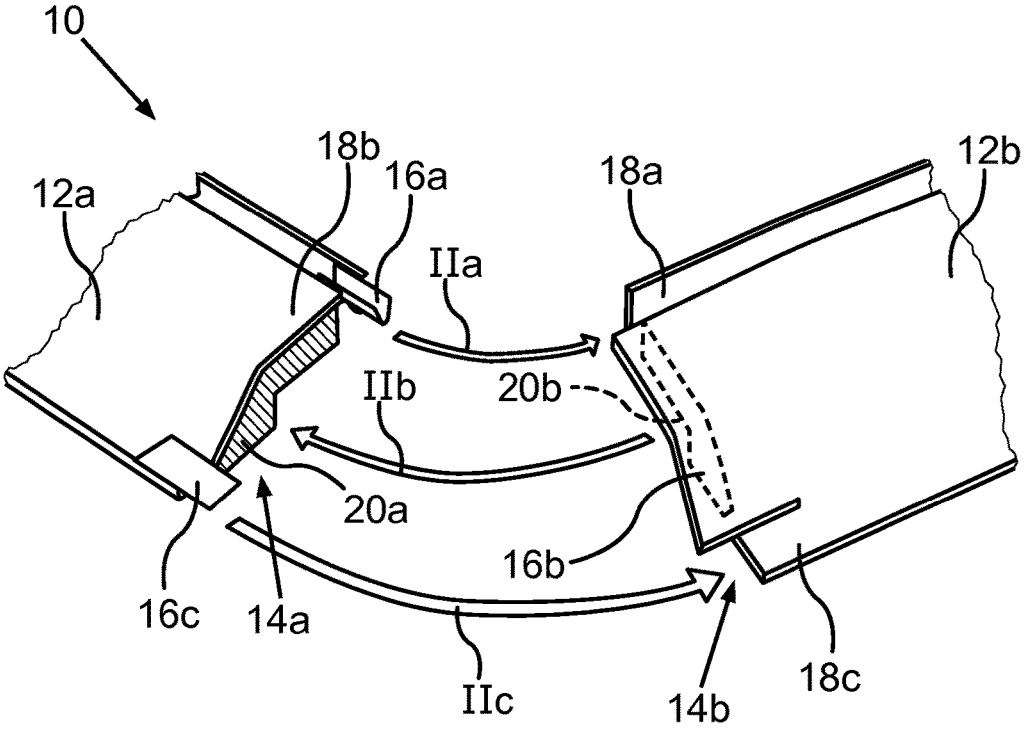
FIG. 2: shows a schematic perspective view of two component segments of the component system according to the present invention in accordance with a second specific embodiment.
Figure 4A:
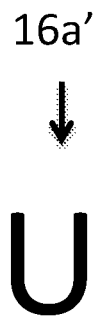
FIGS. 4A and 4B show the overlapping element in the form of a U-shaped element and a hook shaped element.
Figure 4B:
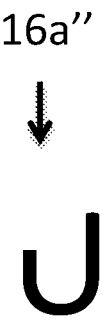

FIG. 2 shows a semi-transparent, schematic perspective view of component system 10 in accordance with a second exemplary embodiment of the present invention. Component system 10 likewise includes a plurality of component segments, of which merely one first component segment 12*a* and a second component segment 12*b* are shown in a cutaway view. It is discernible that the geometries of component segments 12*a*, 12*b*, of first, primarily V-shaped overlapping element 16*a*, and of second overlapping element 16*b* deviate from the preceding exemplary embodiment, while overlapping element 16*c* continues to be cuboid, respectively rectangular in cross section. Moreover, overlapping elements 16*a* and 16*c* are not integrally formed, rather metallurgically bonded to component segment 12*a*, for example by welding, soldering or adhesive bonding. Analogously, second overlapping element 16*b* may be metallurgically bonded to component segment 12*b*, for example by welding, soldering or adhesive bonding. In addition, at the radial inner sides thereof, component segments 12*a*, 12*b* include sealing elements 20*a*, 20*b*, which may be formed as honeycomb seals for turbine blades, for example. However, the basic principle of component system 10 including the alternating covering of overlapping elements 16*a-c* corresponds to that of the preceding exemplary embodiment, so that assembling, respectively joining component segments 12*a*, 12*b*, as illustrated by arrows IIa-c, thereby accomplishes a corresponding overlapping and segment sealing. As a general principle, however, deviating geometries of overlapping elements 16*a-c* are also conceivable. For example, at least one of overlapping elements 16*a-c* may be configured to be hook-shaped, (e.g. element 16*a*", FIG. 4B) thereby allowing component segments 12*a*, 12*b*, in response to the sliding together thereof, to lock engagingly in the manner of a clip-type connection and be fixed in relation to one another. Alternatively or additionally, at least one of the overlapping elements may be configured to be U-shaped (e.g. element 16*a*', FIG. 4B)

What is claimed is:

1. A component system of a turbine engine, the component system comprising:

a first component segment; and a second component segment configurable in a ring segment shape about an axis of a rotor of the turbine engine, so that a first abutment surface of the first component segment abuts against a second abutment surface of the second component segment, wherein, together, the first component segment and the second component segment include at least first, second and third overlapping elements for sealing a gap between the first and second abutment surfaces;

the first and third overlapping elements being configured as first projections in a circumferential direction with respect to the first abutment surface on the first component segment and overlapping radially the second component segment;

the second overlapping element being configured as a second projection in the circumferential direction with respect to the second abutment surface on the second component segment and overlapping radially the first component segment; and, the second overlapping element being axially configured between the first and third overlapping elements;

wherein, the first and third overlapping elements each have a radially inward surface overlapping radially the second component segment, wherein the second overlapping element has a radially inward surface overlapping radially the first component segment, and wherein at least one of the three radially inward surfaces is configured at a radially different distance or in a radially different plane relative to the axis than another of the three radially inward surfaces.

2. The component system as recited in claim 1 wherein at least one of the first, second and third overlapping elements is integrally formed on the respective first or second component segment or is metallurgically bonded to the respective first or second component segment.

3. The component system as recited in claim 1 wherein the first and third overlapping elements are configured at mutually opposing outer regions of the first component segment, or the second overlapping element is configured in the axially middle region of the second component segment.

4. The component system as recited in claim 1 wherein the first, second and third overlapping elements jointly seal the gap between the first and second abutment surfaces.

5. The component system as recited in claim 1 wherein at least one of the first, second and third overlapping elements is configured to be hook-shaped or rectangular in cross section, or trough-shaped, or V-shaped, or U-shaped.

6. The component system as recited in claim 1 wherein the first component segment or the second component segment includes at least one overlapping region configured to complement an associated one of the first, second and third overlapping elements of the respective other of the first and second component segments.

7. The component system as recited in claim 1 wherein the second overlapping element has a larger surface area or a greater axial extent than the first and third overlapping elements.

8. The component system as recited in claim 1 wherein the first component segment or the second component segment is configured as a blade ring segment or as a turbine ring segment.

9. The component system as recited in claim 1 wherein at least one of the first and second component segments is manufactured additively.

10. A method for assembling a component system as recited in claim 1 in a turbine engine, comprising:

joining the first component segment and the second component segment in a way to allow:

the first abutment surface to abut the second abutment surface;

the first and third overlapping elements to overlap radially with the second component segment;

the second overlapping element to overlap radially with the first component segment; and to be axially configured between the first and third overlapping elements.

11. A turbine engine comprising the component system as recited in claim 1.

12. An aircraft engine comprising the component system as recited in claim 1.

13. The component system as recited in claim 1 wherein the first overlapping element is V-shaped and the third overlapping element is rectangular in cross section.

14. The component system as recited in claim 1 wherein the first projections are separated axially by the first abutment surface.

* * * * *